United States Patent [19]

Medin et al.

[11] Patent Number: 5,012,721

[45] Date of Patent: May 7, 1991

[54] REACTIVE ARMOR WALL STRUCTURE

[75] Inventors: Gunnar Medin; Erik Olsson; Sjöö Lennart, all of Eskilstuna; Roger Lundgren, Bromma, all of Sweden

[73] Assignee: Affarsverket FFV, Eskilstuna, Sweden

[21] Appl. No.: 488,519

[22] Filed: Feb. 27, 1990

Related U.S. Application Data

[63] Continuation of Ser. No. 124,996, Nov. 24, 1987, abandoned.

[30] Foreign Application Priority Data

Mar. 27, 1986 [SE] Sweden ..... 8601436

[51] Int. Cl.[5] ..... F41H 5/007

[52] U.S. Cl. ..... 89/36.17

[58] Field of Search ..... 89/36.02, 36.08, 36.17; 109/36, 37; 428/911

[56] References Cited

U.S. PATENT DOCUMENTS

| | | | |
|---|---|---|---|
| 2,578,556 | 12/1951 | Johnston | 109/37 |
| 3,592,148 | 7/1971 | Manis | 109/37 |
| 4,368,660 | 1/1983 | Held | 89/36.17 |
| 4,741,244 | 5/1988 | Ratner et al. | 89/36.17 |

FOREIGN PATENT DOCUMENTS

| | | | |
|---|---|---|---|
| 203908 | 6/1959 | Austria | 89/36.02 |
| 444294 | 5/1927 | Fed. Rep. of Germany | 109/37 |
| 2031658 | 5/1972 | Fed. Rep. of Germany | 89/36.17 |
| 2053345 | 2/1977 | Fed. Rep. of Germany | 89/36.17 |
| 2636595 | 2/1978 | Fed. Rep. of Germany | 89/36.17 |
| 2380528 | 10/1978 | France | 89/36.17 |
| 8404156 | 10/1984 | PCT Int'l Appl. | 428/911 |

*Primary Examiner*—Charles T. Jordan
*Assistant Examiner*—Stephen Johnson
*Attorney, Agent, or Firm*—Fleit, Jacobson, Cohn, Price, Holman & Stern

[57] ABSTRACT

An enclosed active armor arrangement wherein the panels that form the enclosure have a product of the density and the thickness of the side panels that is greater than the product of the density and the thickness of the armor panels to provide for a reflective action on the detonation waves of the explosive. This reflective action accentuates the destructive effect on the incoming explosive charge jet.

7 Claims, 3 Drawing Sheets

REACTIVE ARMOR WALL STRUCTURE

This application is a continuation of application Ser. No. 07/124,996, now abandoned, filed Nov. 24, 1987.

TECHNICAL FIELD

The present invention relates to a reactive or "dynamic" protective armour wall structure for protection against hollow explosive charge jets and comprising one or more separate, replaceable panel structures of which each forms a closed container filled with an explosive charge capable of being detonated by the hollow charge jet.

BACKGROUND PRIOR ART

One such reactive wall structure is known, for example, from the German Patent Specification No. 2.031.658, and is effective to degrade or disturb the hollow charge jet to such an extent as to impair penetration of the jet. One known reason for this is because the jet detonates the explosive charge so as to generate forces which accelerate the plates of the panel structure forwards and backwards towards the jet, therewith degrading a large part thereof.

In this known protective wall structure the explosive charge has the form of an explosive layer positioned on the inner surface of the outer wall of the panel and at a given distance of the inner wall thereof, so as to leave an air gap between the inner wall and the explosive layer. Since this air gap is important to the function of the protective wall structure, the interior of the panel cannot be filled completely with explosive, which limits the efficiency of the protective wall structure. Furthermore, in the case of this protective wall structure it is solely the outer wall of the panel and the explosive layer affixed thereto that constitute the functional part of the protective wall structure when impinged upon by a hollow charge jet.

Furthermore, this known wall structure will not degrade a hollow charge jet which impinges on the wall structure at right angles to the plane thereof with the same degree of efficiency as when the jet impinges obliquely to said plane.

SUMMARY OF THE INVENTION

Accordingly, the object of this invention is to provide a reactive wall structure of the aforesaid kind which will enable a greater amount of explosive to be used in the panels than was possible hitherto, and which is so formed that the whole of the panel structure is operative in degrading or disturbing the hollow charge jet, even when the jet impinges on the wall structure at right angels to the plane thereof.

This object is achieved with a reactive armour wall structure of the aforesaid kind that has the novel characteristic features set forth in the characterizing clause of claim 1.

Further developments of the invention are set forth in the depending claims.

The invention is based on the realization that it is not primarily the dimensions of the explosive charge that influence the ability of the panel structure do degrade the hollow charge jet system but rather the dimensioning of the panel structure, or container, and then primarily the characteristics of the side walls of said structure, in combination with the explosive charge.

The side walls of the inventive panel structure, which extend substantially at right angles to the wall structure, have been given shockwave reflecting properties, so that detonation waves generated within the panel structure by an impinging hollow charge jet or thorn will be reflected back towards the jet and therewith degrade the jet. Consequently, in order for the detonation waves to be reflected continually within the panel structure over a prolonged period during the hollow charge jet sequence, it is necessary to ensure that the panel sidewalls will remain in situ for as long as possible, so as to effect a gradual offload in pressure in the panel structure. This is achieved in accordance with the present invention with the aid of side walls which are so ductile and of such thickness and mass that the product of the density and thickness of respective walls is at least equally as great, and preferably greater than the corresponding density and thickness of remaining walls in the panel structure. The slow offload in pressure obtained in such a panel structure will ensure that the hollow charge jet is effectively degraded, even when the jet impinges on the protective wall or panel structure at right angles to the plane thereof.

The aforesaid remaining walls of the panel structure preferably comprise two armour plates which are arranged in mutual spaced and parallel relationship and are joined to the side wall with the aid of suitable joining elements, optionally supported by confinement strengthening means in order to establish a strengthened holding force.

The best jet degrading effect is achieved when the inventive panel structure, or container, has cylindrical walls, since the load will then be symmetrical when the panel structure is impinged upon in the vicinity of its centre.

A satisfactory jet degrading effect can also be obtained with elliptical or polygonal panel structures, e.g. square or hexagonal panels, with suitable dimensioning of the corners and edges of such panel with regard to their mechanical strength.

Because of the enhanced jet degrading effect afforded by the detonation forces generated in the inventive panel structure, the panel structure can be safely given smaller dimensions, with a resultant decrease in damage to the protected object. The actual projectile with its explosive charge and shrapnel will therewith dominate from the aspect of damage.

BRIEF DESCRIPTION OF THE DRAWINGS

The invention will now be described in more detail with reference to a number of preferred embodiments thereof illustrated in the accompanying schematic drawings, in which.

DESCRIPTION OF A PREFERRED EMBODIMENT

Figure 1:
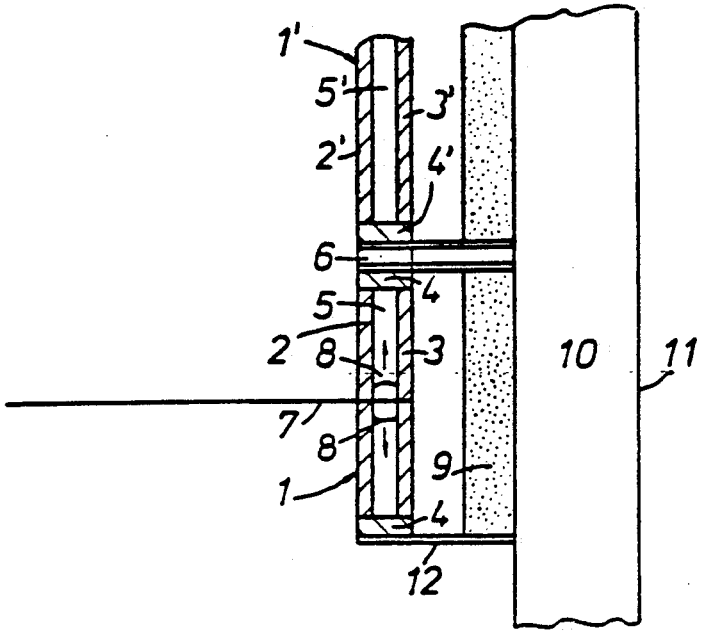
FIGS. 1–4 illustrate the detonation sequence of a protective armour wall structure constructed in accordance with the invention, when struck by a hollow charge jet at right angles thereto.

FIG. 1 illustrates in cross-section two mutually identical panels 1 and 1' forming part of a protective wall structure which is intended to be placed in front of an object 10 that is to be protected against hollow explosive charge jets, e.g. a conventional armoured wall structure 10. Each of the panels comprises two metal plates 2 and 3 which are arranged in mutually parallel spaced relationship and which form respectively the outer and inner walls of the panel structure, and further comprises side walls 4 which extend perpendicularly to the plates 2 and 3 and which are attached sealingly to respective edges of said plates with the aid of joining elements not shown, so that the panel structure has the form of a closed container.

The panel structure 1 is filled completely with an explosive charge 5, e.g. a plastic explosive.

The plates 2 and 3 and the sidewalls 4 may be made, for example, of steel or some equivalent material having a density greater than 2000 kg/m$^3$, preferably greater than 7000 kg/m$^3$.

According to one practical embodiment of the invention the plates 2 and 3 of the panel structure 1 have a hexagonal configuration with a plate thickness of about 3 mm (10 mm), and the side walls 4 have a corresponding hexagonal configuration with a wall thickness of 5 mm (12 mm).

In the illustrated embodiment there is placed between mutually adjacent panel structures a shock-absorbing layer 6 of soft resilient material, such as a plastics or rubber material for example, that has a much lower density than the density of the side walls 4. The layer 6 prevents flashover and serious deformation of mutually adjacent panel structures due to shock, and will also permit the side walls of the panel structure to shift transversely to some extent, when the explosive in the panel structure is detonated. The layer 6 is preferably slightly thicker than the side walls 4, and suitably has a thickness of at least about 6 mm.

FIG. 1 illustrates schematically a hollow charge jet or thorn 7 which strikes the panel 1 at right angles to the plane thereof and penetrates the plates 2 and 3, and which subsequently continues along a path 7*a*, cf. FIG. 2, and exits through the rear side of the panel. The hollow charge jet 7 initiates detonation of the explosive charge 5, therewith giving rise to detonation waves 8 which propagate between the plates 2 and 3, in a direction towards the side walls 4, and which impinge obliquely on said plates 2 and 3.

Figure 2:
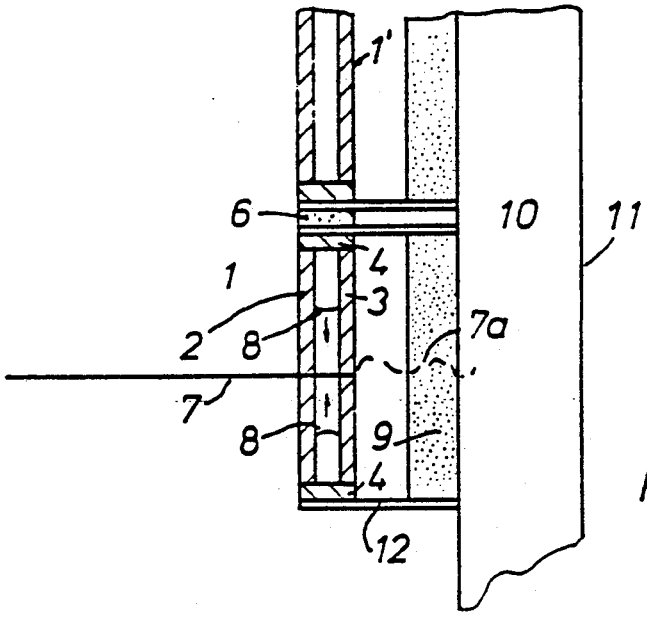

As shown in FIG. 2, the detonation waves 8 are reflected by the side walls 4 and propagate back towards the hollow charge jet, these detonation waves (load relieving waves) colliding with the jet and degrading the jet.

The hollow charge jets will have already been disturbed to some extent at an earlier stage, by detonation waves reflected from regions of the plates 2 and 3 located in the close vicinity of the jet.

Because of this disturbance or degradation of the jet caused by the interaction of the reflected detonation waves with the jet, the hollow charge jet will be imparted a substantially sinusoidal propagation path 7*a* through the panel.

Figure 3:
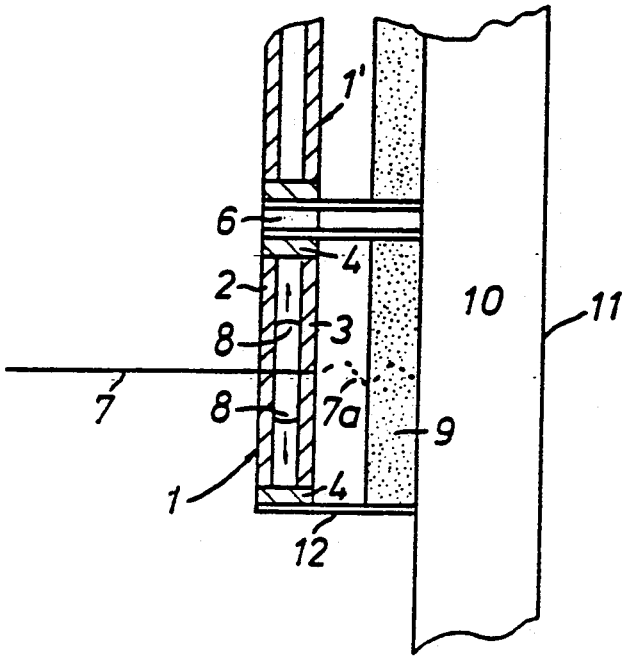
Figure 4:
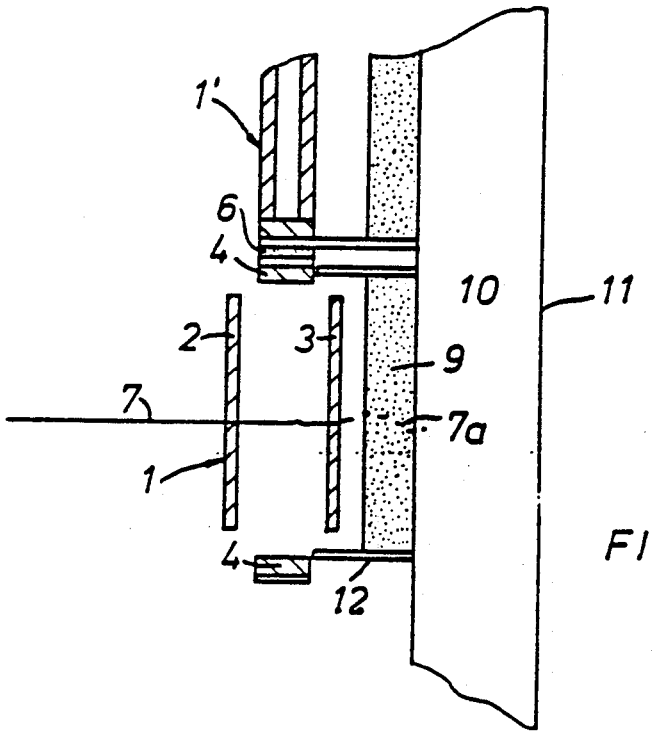

The reflected detonation waves 8 are again thrown back towards the side walls 4, subsequent to interaction of the waves with the hollow charge jet, vide FIG. 3. This sequence of events continues until the side walls 4 and the plates 2 and 3 are parted from one another, whereupon the panel structure is relieved of pressure and the reflected detonation waves are lost to the surrounding atmosphere.

The plates 2 and 3 will also be blown away, whereas the side walls 4 will be displaced transversely so as to enter the resilient shock-absorbing layer 6 while compressing the same, possibly with a subsequent rebound of the side walls. When only one panel assembly is used, the side walls will also be blown away subsequent to parting company with the plates 2 and 3.

In addition to absorbing shockwaves, the layer 6 will also prevent flashover between mutually adjacent panel structures and will protect these panel structures against serious deformation and damage.

When constructing armoured wall structures, it is not possible to place the panel structures contiguous with one another, for structural reasons.

In order to protect the object 10 against the flying plate 3 located immediately adjacent thereto, a shockwave absorbing layer 9 may be placed on the object 10, so as to prevent shrapnel entering the object at 11.

The layer 9 will also cause the outwardly flying plate 3 to bounce back powerfully towards the hollow charge jet, therewith further degrading the jet.

The distance between the panel structures, and e.g., a conventional armoured wall structure 10 may vary from 0 mm to several hundreds of millimeters, with essentially the same effect.

The side walls 4 are preferably dimensioned so that when the explosive charge is detonated the walls will have a velocity which is equal to or less than the velocity of the plates 2 and 3. Such dimensioning can be achieved through appropriate selection of material, thickness etc. Since the manner in which the side walls can be dimensioned in order to meet the aforesaid requirements will be obvious to those skilled in this art, no further description with regard hereto will be given here. The side walls 4 will also preferably have a high dynamic mechanical strength, and may therefore be made of, e.g., steel as beforementioned.

The panel structures are fitted to the protected object 10 with the aid of thin plates 12 placed on respective opposite sides of the panel structure.

Figure 5:
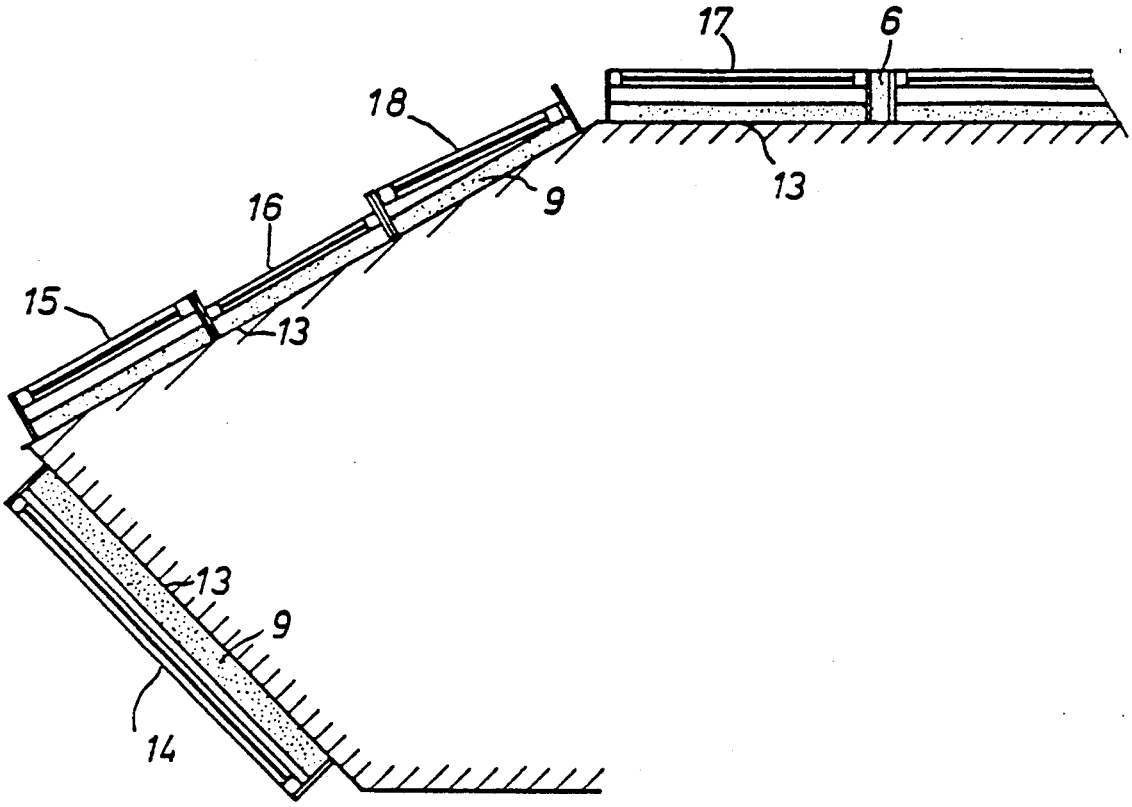
FIG. 5 illustrates various applications of the invention used in conjunction with antitank mines.

FIG. 5 illustrates panel structures 1 intended for various applications at an armoured vehicle or tank front 13.

The reference numerals 14 and 15 designate panel structures 1 which define an air gap and with which a damping material is used.

The reference 16 designates a panel structure 1 with which solely a damping material is used.

The reference 17 designates panel structures 1 with which a shockwave absorbing layer 6 is provided between the panel structures and a damping material is provided between the panel structures and the protective object.

The reference 18 designates a panel structure which defines an air gap that slopes down to zero width.

These various arrangements afford good protection and prevent flashover between the panel structures.

The additional degrading function of the reactive panel structure provided by the side walls can be optimized with regard to certain significant aspects:

The explosive charge shall have a high detonation pressure (>10 GPa), which will generate a high pressure in the panel structure or container, and therewith radically disturb or degrade the hollow charge jet.

This disturbance of the hollow charge jet is enhanced by the high density and thickness of the side walls of the dynamic panel structure.

The reactive wall structure should have a flow stress or yield point $\sigma_s$ in excess of 200 MPa.

We claim:

1. A reactive armour wall structure for protection against hollow explosive charge jets, comprising:

at least one closed container formed by a separate and replaceable panel structure, and in which a high detonation pressure can be produced, said separate and replaceable panel structure consisting of two mutually spaced and mutually parallel armour walls and mutually spaced armour side walls extending substantially at right angles to said two mutually spaced and mutually parallel armour walls across opposite portion thereof, to define said closed container, an explosive substance filling said closed container and which is detonated by one of said hollow explosive charge jets, said mutually spaced armour side walls having a density greater than 2000 kg./m$^3$ such that said side walls possess high shockwave reflecting properties, and so that detonation shockwaves initiated in said explosive substance in said closed container by the hollow explosive charge jet which propagate in respective opposite directions away from the jet and towards said side walls are substantially reflected by said side walls backing respective reverse directions towards the jet to disturb the jet, the side walls also being made of ductile material and having a thickness and mass such that a product of density and thickness of said side walls is at least equal to a product of density and thickness of said two mutually spaced and mutually parallel armour walls of said separate and replaceable panel structure.

2. A reactive armour wall structure according to claim 1, wherein said two mutually spaced and parallel armour walls of said separate and replaceable panel structure comprise two mutually spaced and mutually parallel armour plates which are able to move in relation to one another as a protective function of the wall structure.

3. A reactive armour wall structure according to claim 1, wherein the explosive substance has a detonation pressure in excess of 10 GPa.

4. A reactive armour wall structure according to claim 1, wherein each of said side walls has a yield point ($\sigma_s$) in excess of 200 MPa.

5. A reactive armour wall structure according to claim 1, and further comprising:

a shock absorbing material effective in preventing flashover arranged between adjacent panel structures when more than one of said panel structures is incorporated in said reactive armour wall structure.

6. A reactive armour wall structure according to claim 1, and further comprising:

a material having good shockwave absorbing properties placed between the reactive armour wall structure and an object to be protected.

7. A reactive armour wall structure according to claim 1, wherein said mutually spaced armour side walls have high shockwave reflecting properties equivalent to steel.

* * * * *